US008684105B2

(12) United States Patent
Yoshikane et al.

(10) Patent No.: US 8,684,105 B2
(45) Date of Patent: Apr. 1, 2014

(54) POWER TOOL

(75) Inventors: Kiyonobu Yoshikane, Anjo (JP); Yoshitaka Machida, Anjo (JP)

(73) Assignee: Makita Corporation, Anjo-Shi (JP)

( * ) Notice: Subject to any disclaimer, the term of this patent is extended or adjusted under 35 U.S.C. 154(b) by 394 days.

(21) Appl. No.: 13/089,944

(22) Filed: Apr. 19, 2011

(65) Prior Publication Data

US 2011/0259623 A1 Oct. 27, 2011

(30) Foreign Application Priority Data

Apr. 23, 2010 (JP) ..... 2010-100362

(51) Int. Cl.
*B25B 21/00* (2006.01)
*B25D 16/00* (2006.01)

(52) U.S. Cl.
USPC ..... 173/178; 173/48; 173/201; 173/216; 192/54.5; 192/223

(58) Field of Classification Search
USPC ..... 173/48, 201, 176, 178, 216, 217; 192/54.5, 37, 45.1, 223.2, 223; 81/57.1, 59.1, 474
See application file for complete search history.

(56) References Cited

U.S. PATENT DOCUMENTS 1,684,633 A * 9/1928 Levedahl ..... 81/54
1,871,720 A * 8/1932 Meunier ..... 279/144
1,914,537 A * 6/1933 Smith ..... 192/48.4
1,958,126 A * 5/1934 Bowen ..... 242/597.6
2,225,091 A * 12/1940 Wilhide ..... 173/93.6
2,687,025 A * 8/1954 Wildhaber ..... 464/158
3,174,606 A * 3/1965 Hornschuch et al. ..... 192/150
3,223,210 A * 12/1965 Schweizer ..... 477/11
5,372,206 A * 12/1994 Sasaki et al. ..... 173/178
6,173,792 B1 * 1/2001 Hald ..... 173/178
6,311,787 B1 * 11/2001 Berry et al. ..... 173/176
6,338,404 B1 * 1/2002 Chen ..... 192/223

FOREIGN PATENT DOCUMENTS

JP A-51-111550 10/1976
JP U-62-174151 11/1987

OTHER PUBLICATIONS

Oct. 10, 2013 Office Action issued in Japanese Patent Application No. 2010-100362.

* cited by examiner

*Primary Examiner* — Scott A. Smith
(74) *Attorney, Agent, or Firm* — Oliff PLC

(57) ABSTRACT

A technique is provided which improves durability in a power tool having a torque transmission device. The representative power tool has a torque transmission device 151. The torque transmission device 151 includes a projection 171 formed on one of opposed surfaces of a first rotating member 153 and a second rotating member 155 and protruding in a direction of a rotational axis, a recess 161 for receiving the projection 171, which is formed in the other of the opposed surfaces and recessed in the direction of the rotational axis, a projection-side engagement surface 175*a* formed on the projection 171, and a recess-side engagement surface 165*a* formed on the recess 171. Torque is transmitted when the projection-side and recess-side engagement surfaces 175*a*, 165*a* are engaged with each other, while the torque transmission is interrupted when the projection-side and recess-side engagement surfaces 175*a*, 165*a* are disengaged from each other. The projection-side and recess-side engagement surfaces 175*a*, 165*a* are inclined at a predetermined angle β with respect to normals P of the first and second rotating members 153, 155.

6 Claims, 7 Drawing Sheets

POWER TOOL

BACKGROUND OF THE INVENTION

1. Field of the Invention

The invention relates to a power tool having a torque transmission device that transmits torque and interrupts torque transmission between an input shaft and an output shaft, and more particularly, to a mechanical torque transmission device that transmits torque by engagement of a projection and a recess.

2. Description of the Related Art

Japanese laid-open patent publication No. 51-111550 discloses a torque transmission device provided as a torque limiter (an overload protection device) that protects a machine from excessive torque developed for any reason during torque transmission, or particularly, a mechanical torque transmission device that transmits torque by engagement of a projection and a recess.

In the above-described torque transmission device, a projection is formed on one of clutch surfaces (engagement surfaces) of a driving-side disk clutch and a driven-side disk clutch which are coaxially arranged and a recess is formed in the other clutch surface, and torque transmission is effected by engagement of the projection and the recess with each other and interrupted by disengagement of the projection and the recess from each other. The projection-side and recess-side engagement surfaces which are formed as torque transmitting surfaces on the projection and the recess are inclined at a predetermined angle in a direction of a rotational axis and linearly extend along normals of the disk clutches in radial directions.

The projection and the recess of the torque limiter are engaged with each other by spring force which defines maximum transmitting force. When overload torque is developed, the projection and the recess are caused to slide with respect to each other in an axial direction against spring force by axial force which acts between the projection-side and recess-side engagement surfaces (inclined surfaces in the direction of the rotational axis), so that the projection and the recess are disengaged from each other. Particularly, when the torque transmission device is used as the torque limiter, the engagement surfaces are disengaged from each other while being subjected to heavy load, so that the engagement surfaces easily wear. In this point, further improvement is desired.

SUMMARY OF THE INVENTION

Accordingly, it is an object of the invention to improve durability in the power tool having the torque transmission device.

Above-described object can be achieved by the claimed invention. A preferred embodiment of the power tool according to the invention has a torque transmission device that transmits torque and interrupts torque transmission between a first rotating member and a second rotating member which are coaxially arranged to be opposed to each other. The torque transmission device has a projection which is formed on one of opposed surfaces of the first and second rotating members and protrudes in a direction of a rotational axis, a recess for receiving the projection, which is formed in the other of the opposed surfaces and recessed in the direction of the rotational axis, a projection-side engagement surface formed on a side surface of the projection in a direction of torque transmission, and a recess-side engagement surface formed on a side surface of the recess in the direction of torque transmission. Torque is transmitted when the projection-side and recess-side engagement surfaces are engaged with each other by relative movement of the first and second rotating members toward each other, while the torque transmission is interrupted when the projection-side and recess-side engagement surfaces are disengaged from each other by relative movement of the first and second rotating members away from each other. The projection-side and recess-side engagement surfaces are inclined at a predetermined angle with respect to normals of the first and second rotating members. Further, in the construction in which the projection extends radially outward from the rotational axis side of the rotating member, the manner in which "the engagement surfaces are inclined" suitably includes both the manner in which the engagement surfaces are inclined in a forward direction of torque transmission toward a radially outer end of the projection in its extending direction, and the manner in which the engagement surfaces are inclined in a rearward direction of torque transmission toward the radially outer end of the projection.

According to the preferred embodiment of the invention, in the mechanical torque transmission device that transmits torque by engagement of the projection-side and recess-side engagement surfaces with each other and interrupts the torque transmission by disengagement of the projection-side and recess-side engagement surfaces from each other, the projection-side and recess-side engagement surfaces are inclined at a predetermined angle with respect to normals of the rotating members. In other words, an edge line (straight line) which connects a radially inner end and a radially outer end of the projection is inclined at the predetermined angle with respect to a normal of the rotating member. With such a construction, an area of contact between the projection-side engagement surface and the recess-side engagement surface can be increased, compared with a conventional construction in which each of the engagement surfaces linearly extends along a normal. Therefore, pressure per unit area on the engagement surfaces is reduced, so that durability can be improved.

According to a further aspect of the power tool in the invention, provided that the recess is formed on the torque transmission side, each of the projection-side and recess-side engagement surfaces is inclined in a forward direction of torque transmission toward its radially outer end. According to the invention, when viewed from the axial direction of the rotating member, each of the projection and the recess is shaped such that its width decreases toward its radially outer end in the radially extending direction. Therefore, when the rotating members are formed by using dies, they can be easily demolded, so that ease of manufacture is increased.

According to a further aspect of the power tool in the invention, the projection-side engagement surface is formed as a lead surface in which an edge line on one side (base side) adjacent to the rotating member or an edge line on the other side (top side) far from the rotating member serves as a guide. According to the invention, surface contact between the engagement surfaces can be constantly maintained while the projection-side and recess-side engagement surfaces are engaged with each other.

According to a further aspect of the power tool in the invention, the torque transmission device is provided as a torque limiter which interrupts torque transmission from the first rotating member to the second rotating member when torque exceeding a specified value acts on the second rotating member. The torque limiter is provided as an overload protection device which protects the power tool from excessive torque developed during operation. The engagement surfaces are disengaged from each other while being subjected to heavy load. Therefore, according to this invention, usefulness can be further enhanced by application to a torque limiter which is used under such tough conditions.

According to a further aspect of the power tool in the invention, the rotating member having the recess is designed as a driving-side member for transmitting torque and the rotating member having the projection is designed as a driven-side member for receiving the torque. The driving-side member has a gear integrally formed on its periphery. According to the invention, by provision of the construction in which the rotating member having the gear integrally formed on its periphery is provided as the driving-side member and the recess is formed therein, compared with a construction in which the projection is formed on the driving-side member, a gearing part can be more easily manufactured without interference of the projection.

According to the invention, a durability of a torque transmission device can be improved within a power tool having the torque transmission device. Other objects, features and advantages of the invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved power tools and method for using such power tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
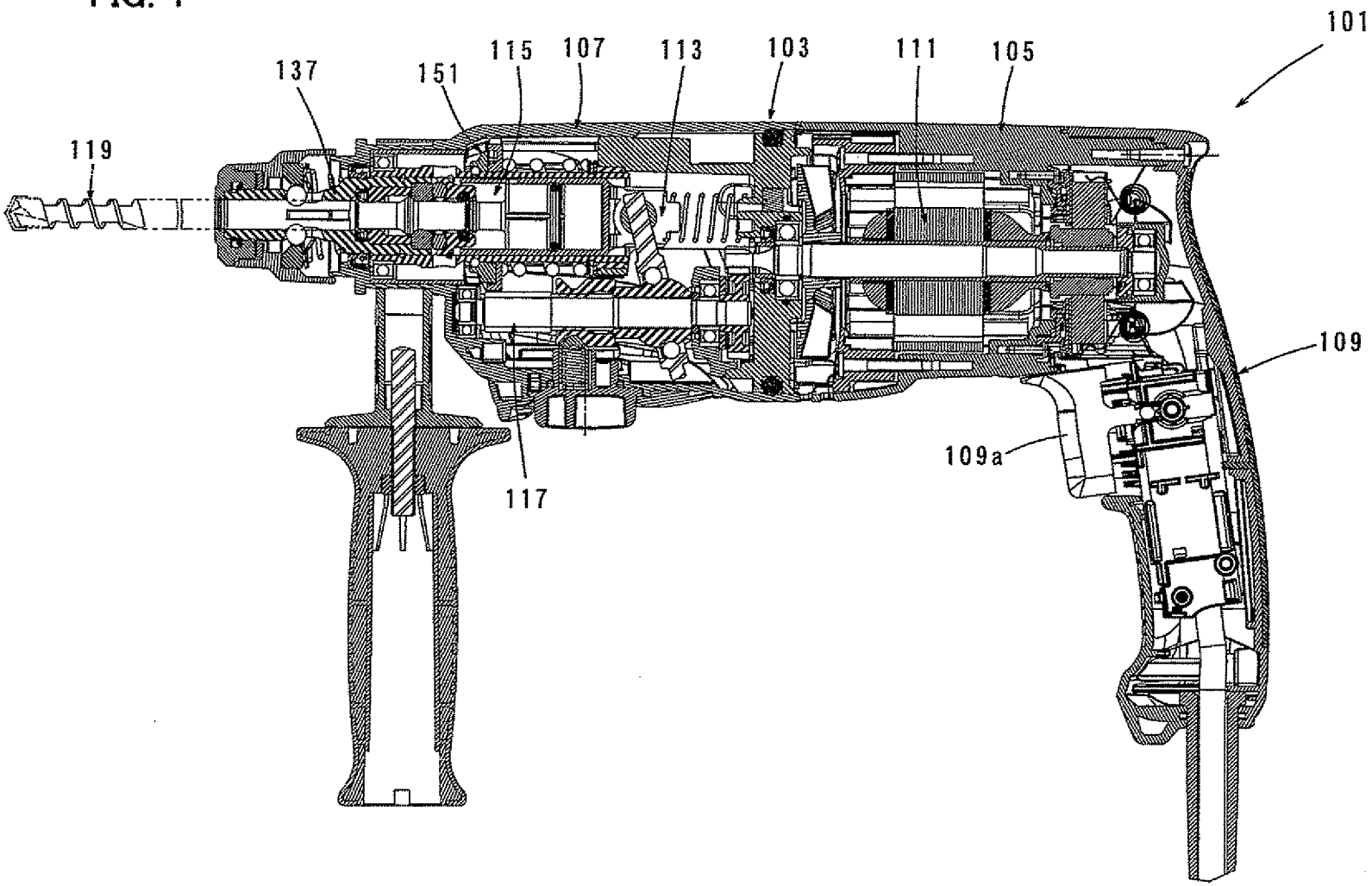
FIG. 1 is a sectional side view showing an entire structure of a hammer drill according to an embodiment of the invention.

A representative embodiment of the invention is now described with reference to FIGS. 1 to 12. In this embodiment, an electric hammer drill is explained as a representative example of a power tool according to the invention. As shown in FIG. 1, a hammer drill 101 of this embodiment mainly includes a body 103 that forms an outer shell of the hammer drill, an elongate hammer bit 119 detachably coupled to one end (on the left as viewed in FIG. 1) of the body 103 in a longitudinal direction of the hammer drill 101 via a tool holder 137, and a handgrip 109 that is designed to be held by a user and connected to the other end (on the side opposite to the hammer bit 119) of the body 103 in its longitudinal direction. The body 103 forms a tool body. A tool bit in the form of the hammer bit 119 is held by the tool holder 137 such that it is allowed to reciprocate in its axial direction (the longitudinal direction of the body 103) with respect to the tool holder 137 and prevented from rotating in its circumferential direction with respect to the tool holder.

The body 103 mainly includes a motor housing 105 that houses a driving motor 111 and a gear housing 107 that houses a motion converting section 113, a power transmitting section 117 and a striking part 115. The driving motor 111 is driven when the user depresses an operating member in the form of a trigger 109*a* which is disposed on the handgrip 109. Further, in this embodiment, for the sake of convenience of explanation, the hammer bit 119 side is taken as the front or tool front region and the handgrip 109 side as the rear or tool rear region.

Figure 2:
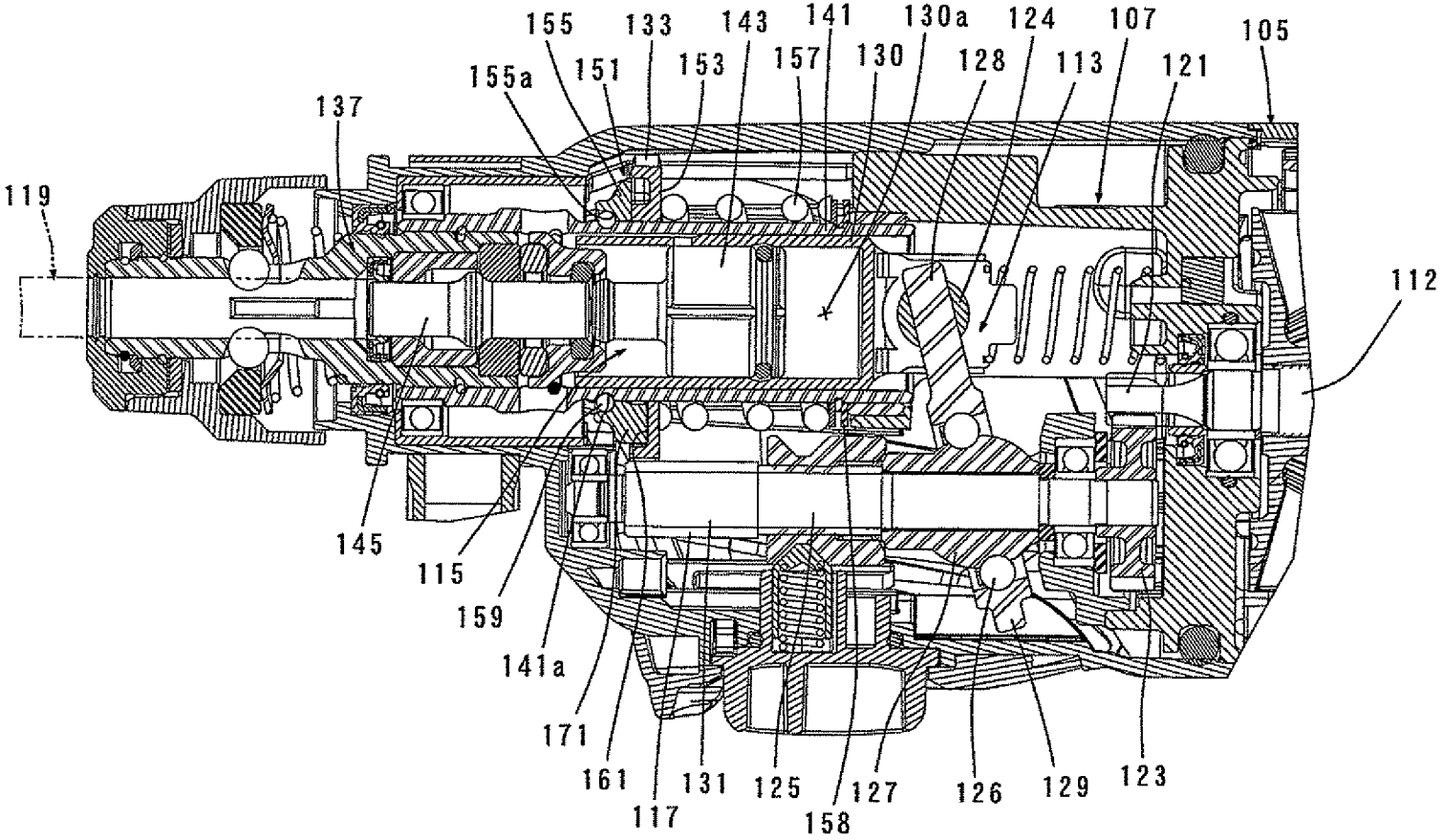
FIG. 2 is an enlarged view of an essential part of the hammer drill.

FIG. 2 is an enlarged sectional view showing the motion converting section 113, the striking part 115 and the power transmitting section 117. The motion converting section 113 appropriately converts a rotating output of the driving motor 111 into linear motion and then transmits it to the striking part 115. Then, an impact force is generated in the axial direction of the hammer bit 119 via the striking part 115. Further, the power transmitting section 117 appropriately reduces the speed of the rotating output of the driving motor 111 and transmits it to the hammer bit 119 as a rotating force, so that the hammer bit 119 is caused to rotate in the circumferential direction.

The motion converting section 113 mainly includes a driving gear 121 that is disposed on a motor output shaft 112 of the driving motor 111 extending in the axial direction of the hammer bit 119 and is rotated in a vertical plane by the driving motor, a driven gear 123 that engages with the driving gear 121, a rotating element 127 that rotates together with the driven gear 123 via an intermediate shaft 125, a swinging ring 129 that is caused to swing in the axial direction of the hammer bit 119 by rotation of the rotating element 127, and a cylindrical piston 130 that has a bottom and is caused to reciprocate within a cylinder 141 by swinging movement of the swinging ring 129.

The intermediate shaft 125 is disposed in parallel (horizontally) to the axial direction of the hammer bit 119. The outer periphery of the rotating element 127 fitted onto the intermediate shaft 125 is inclined at a predetermined angle with respect to the axis of the intermediate shaft 125. The swinging ring 129 is rotatably mounted on the inclined outer periphery of the rotating element 127 via a bearing 126 and caused to swing in the axial direction of the hammer bit 119 by rotation of the rotating element 127. The swinging ring 129 has a swinging rod 128 extending upward (in the radial direction) therefrom in a direction transverse to the axial direction of the hammer bit 119. The swinging rod 128 is rotatably connected to a driving element in the form of the cylindrical piston 130 via a cylindrical element 124. The rotating element 127, the swinging ring 129 and the cylindrical piston 130 form a swinging mechanism.

The power transmitting section 117 mainly includes a first transmission gear 131 formed on the other end (front end) of the intermediate shaft 125 in its axial direction, a second transmission gear 133 that engages with the first transmission gear 131 and is caused to rotate around the axis of the hammer bit 119, the cylinder 141 connected to the second transmission gear 133 via a torque limiter 151, and the tool holder 137 that is caused to rotate around the axis of the hammer bit 119 together with the cylinder 141. The cylinder 141 and the tool holder 137 are coaxially disposed with respect to each other and form a final axis of the power transmitting section 117. The torque limiter 151 is provided as an overload protection device which serves to interrupt torque transmission when torque acting on the final axis of the power transmitting section 117 exceeds a specified value. The torque limiter 151 is a feature that corresponds to the "torque transmission device" according to the invention. The torque limiter 151 is described below.

The striking part 115 mainly includes a striker 143 that is slidably disposed within the bore of the cylindrical piston 130, and an impact bolt 145 that is slidably disposed within the tool holder 137 and transmits the kinetic energy of the striker 143 to the hammer bit 119.

In the hammer drill 101 constructed as described above, when the driving motor 111 is driven by a user's depressing operation of the trigger 109*a* and the intermediate shaft 125 is rotationally driven, the cylindrical piston 130 is caused to linearly slide within the cylinder 141 via the motion converting section 113 which mainly includes the swinging mechanism. The striker 143 is caused to reciprocate within the cylindrical piston 130 by the action of an air spring or air pressure fluctuations within an air chamber 130*a* of the cylindrical piston 130 which is caused by the sliding movement of the cylindrical piston 130. The striker 143 then collides with the impact bolt 145 and transmits the kinetic energy caused by the collision to the hammer bit 119.

When the first transmission gear 131 is caused to rotate together with the intermediate shaft 125, the cylinder 141 is caused to rotate in a vertical plane via the second transmission gear 133 engaged with the first transmission gear 131, and the torque limiter 151, which in turn causes the tool holder 137 and the hammer bit 119 held by the tool holder 137 to rotate together with the cylinder 141. Thus, the hammer bit 119 performs a hammering movement in the axial direction and a drilling movement in the circumferential direction, so that a drilling operation is performed on a workpiece (concrete).

Further, the hammer drill 101 according to this embodiment can be switched not only to hammer drill mode in which the hammer bit 119 performs a hammering movement and a drilling movement in the circumferential direction, but also to drilling mode in which the hammer bit 119 performs only a drilling movement. This mode switching mechanism is not directly related to the invention and therefore it is not described in further details.

The torque limiter 151 mounted in the power transmitting section 117 is now explained with reference to FIGS. 2 to 9. FIG. 2 shows an entire structure of the torque limiter 151. The torque limiter 151 is coaxially disposed on the outside of the cylinder 141. Further, the torque limiter 151 mainly includes a driving-side flange 153 and a driven-side flange 155 which are opposed to each other in the axial direction, and a biasing spring 157 (compression coil spring) which biases the flanges 153, 155 in a direction toward each other. The driving-side flange 153 and the driven-side flange 155 are features that correspond to the "first rotating member" and the "second rotating member", respectively, according to the invention. The second transmission gear 133 which is engaged with the first transmission gear 131 is formed around the driving-side flange 153. Specifically, the driving-side flange 153 according to this embodiment is configured as a flange member having the second transmission gear 133 integrally formed on its periphery.

Figure 9:
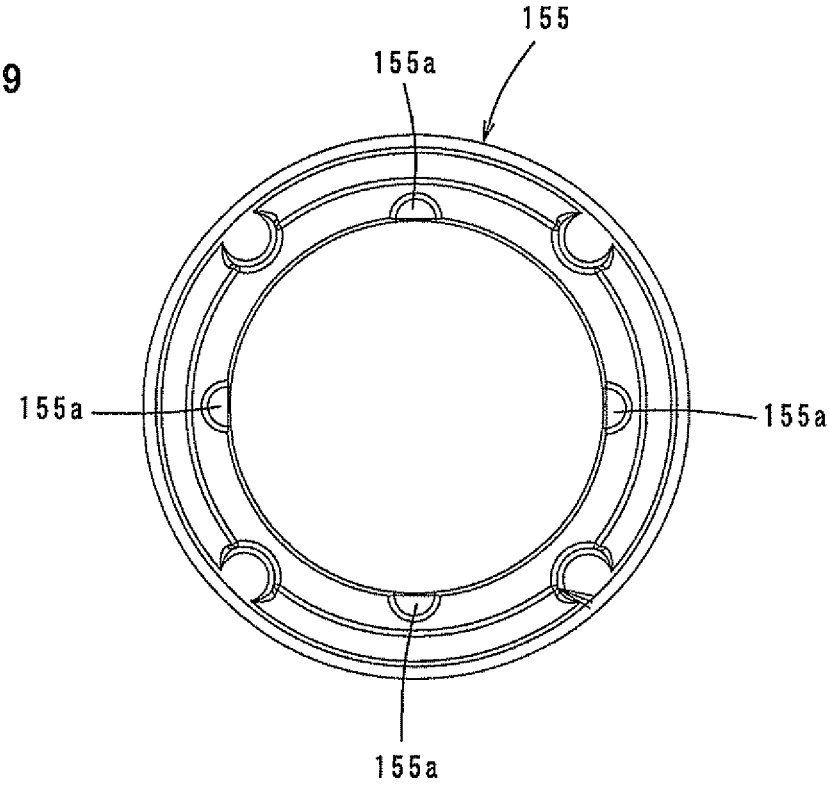
FIG. 9 is a bottom view showing the driven-side flange of the torque limiter.

The driving-side flange 153 is loosely fitted onto the cylinder 141 and can rotate and move in the axial direction with respect to the cylinder 141. The driven-side flange 155 is fitted onto the cylinder 141 in front of the driving-side flange 153 such that it can rotate together with the cylinder 141 via a plurality of balls (steel balls) 159. The balls 159 are disposed between a plurality of spherical recesses 155*a* which are formed in the inner surface of the flange 155 and radially recessed and a plurality of spherical recesses 141*a* which are formed in the outer surface of the cylinder 141 and shaped to be matched with the spherical recesses 155*a*. In this embodiment, four each of the spherical recesses 151*a*, 141*a* and the balls 159 are provided and spaced evenly (at angular intervals of 90 degrees) in the circumferential direction (see FIG. 9 showing the spherical recess 151*a* of the driven-side flange 155).

A recess 161 and a projection 171 are formed on end surfaces of the driving-side flange 153 and the driven-side flange 155 facing each other in the axial direction and shaped to be engaged with each other. Torque is transmitted from the driving-side flange 153 to the driven-side flange 155 when the recess 161 and the projection 171 are engaged with each other, while the torque transmission is interrupted when the projection 171 is disengaged from the recess 161. In this embodiment, the recess 161 is formed in the end surface of the driving-side flange 153 in the axial direction and the projection 171 is formed in the end surface of the driven-side flange 155 in the axial direction. The biasing spring 157 is disposed on the outside of the cylinder 141 at the rear of the driving-side flange 153. Further, the biasing spring 157 is disposed between the driving-side flange 153 and a spring receiving ring 158 fixedly mounted on the cylinder 141, and presses and biases the driving-side flange 153 toward the driven-side flange 155 or in the direction that engages the recess 161 with the projection 171.

Figure 3:
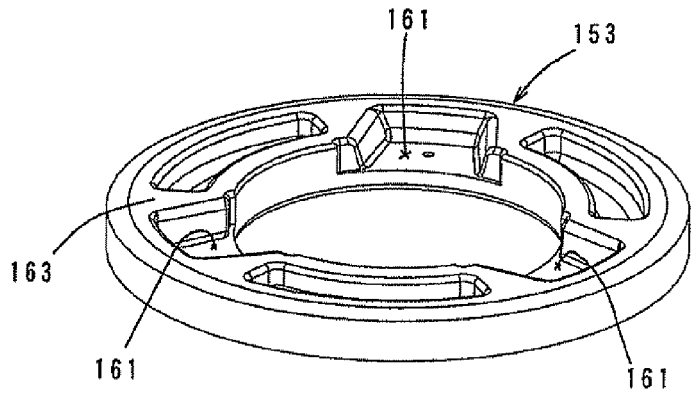
FIG. 3 is a perspective view showing a driving-side flange of a torque limiter.
Figure 4:
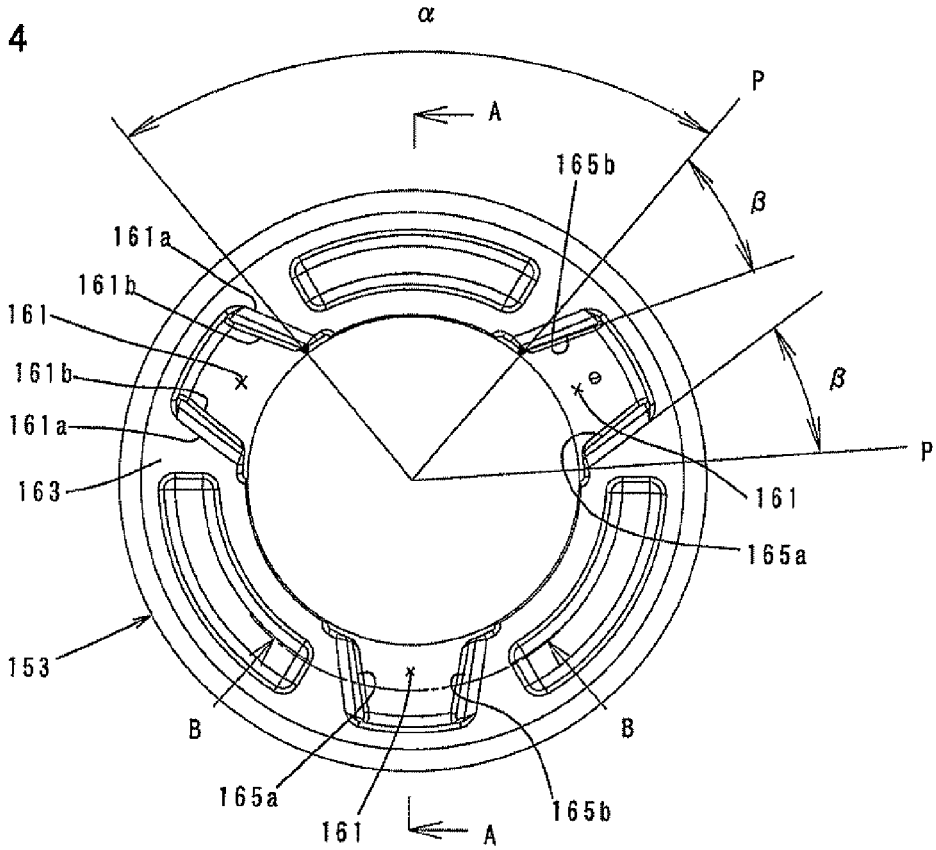
FIG. 4 is a plan view showing the driving-side flange of the torque limiter.
Figure 5:
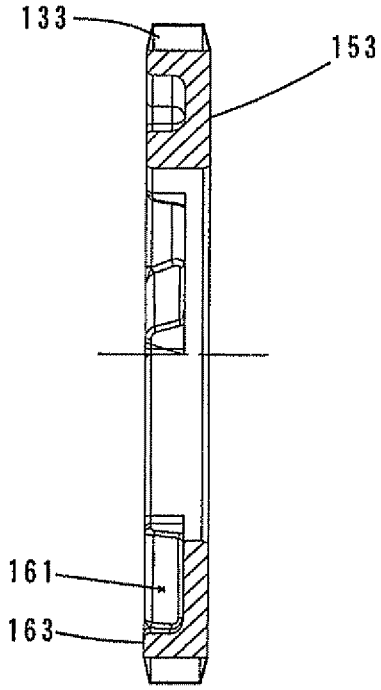
FIG. 5 is a sectional view taken along line A-A in FIG. 4.
Figure 6:
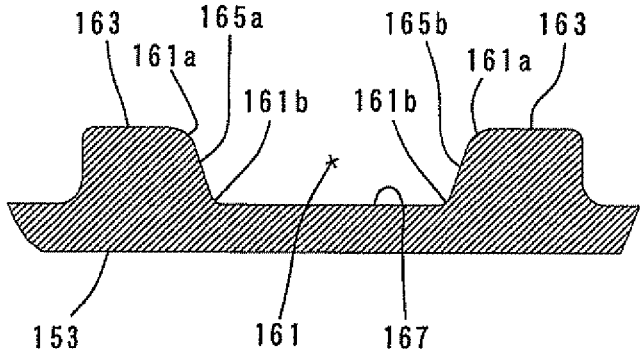
FIG. 6 is a sectional view taken along line B-B in FIG. 4.
Figure 7:
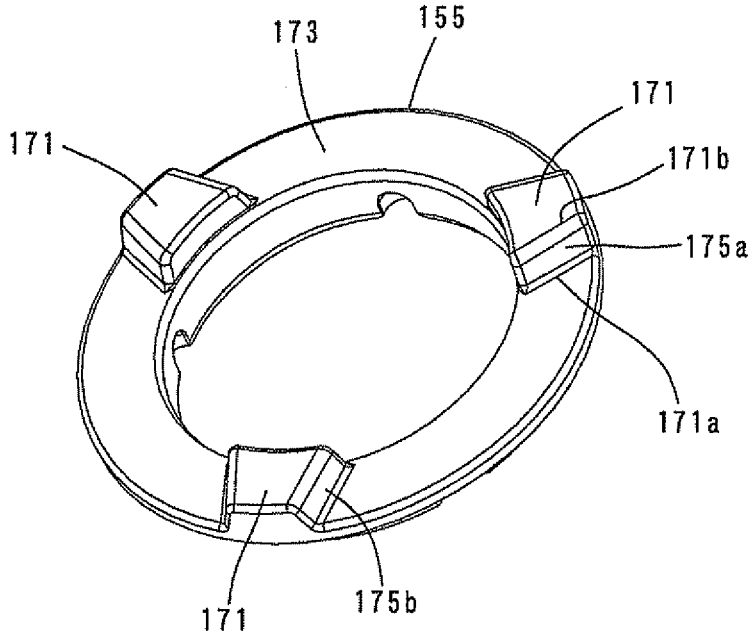
FIG. 7 is a perspective view showing a driven-side flange of the torque limiter.
Figure 8:
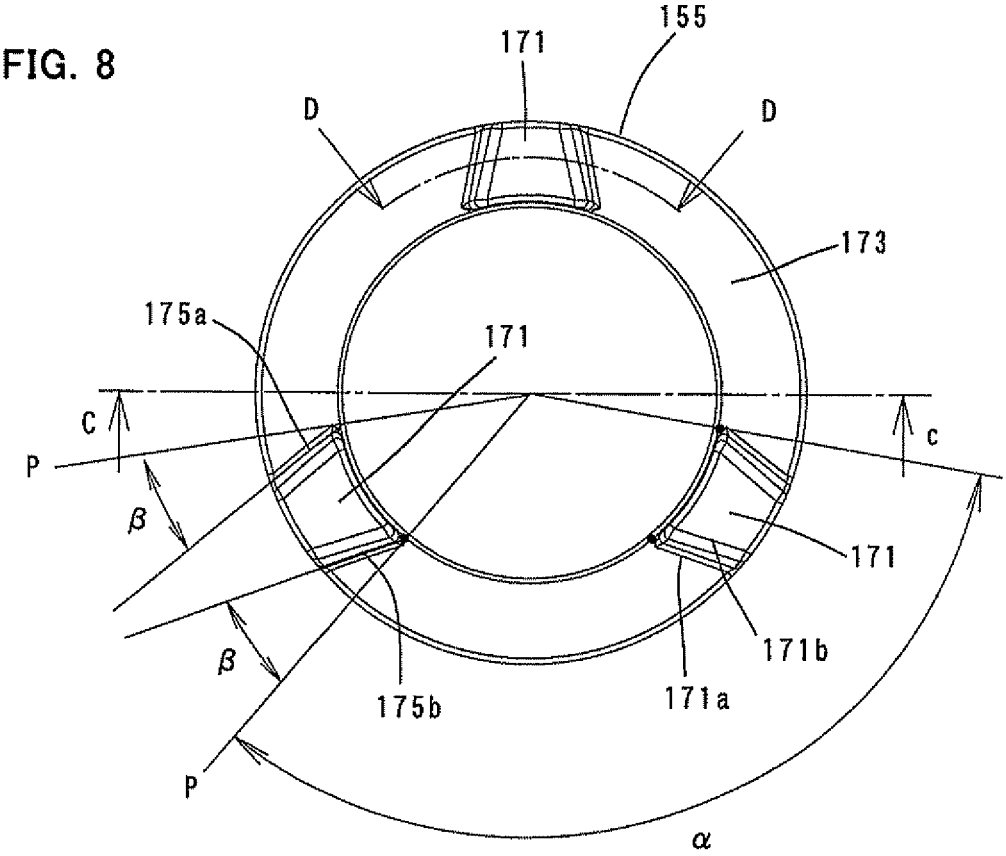
FIG. 8 is a plan view showing the driven-side flange of the torque limiter.

FIGS. 3 to 6 show the structure of the driving-side flange 153, and FIGS. 7 to 11 show the structure of the driven-side flange 155. This embodiment relates to the shapes of the recess 161 and the projection 171. As shown in FIGS. 3 and 4, three recesses 161 are formed in an axial end surface 163 (hereinafter referred to as a flange end surface) of the driving-side flange 153 facing the driven-side flange 155, and spaced at even angular intervals $\alpha$ (120 degrees) in the circumferential direction. Similarly, as shown in FIGS. 7 and 8, three projections 171 are formed in an axial end surface 173 (hereinafter referred to as a flange end surface) of the driven-side flange 155 facing the driving-side flange 153, and spaced at even angular intervals $\alpha$(120 degrees) in the circumferential direction.

As shown in FIGS. 5 and 6, each of the recesses 161 is formed by recessing the flange end surface 163 of the driving-side flange 153 to a predetermined depth in the direction of the rotational axis and has a width in the circumferential direction of the flange which decreases toward its bottom. Specifically, two sides 165*a*, 165*b* of the recess 161 are configured as inclined surfaces extending transversely to the circumferential direction of the flange and inclined toward each other (the distance between them decreases) toward the bottom. Further, as shown in FIG. 4, the recess 161 has a radially inner end open to a radially inner surface flange and a radially outer end closed to a radially outer surface of the flange. Furthermore, as shown in FIG. 6, a bottom surface 167 of the recess 161 is a flat surface parallel to the flange end surface 163.

Figure 10:
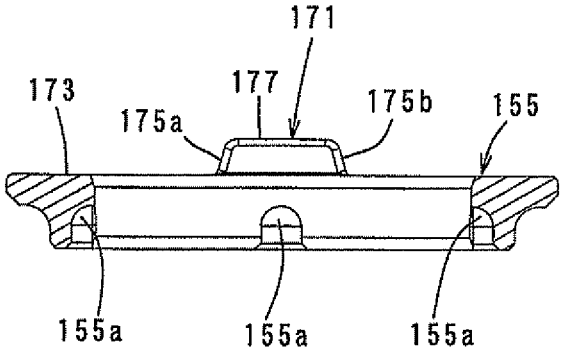
FIG. 10 is a sectional view taken along line C-C in FIG. 8.
Figure 11:
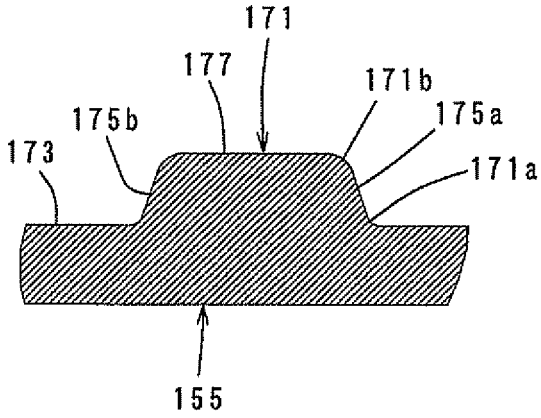
FIG. 11 is a sectional view taken along line D-D in FIG. 8.

As shown in FIGS. 10 and 11, each of the projections 171 protrudes to a predetermined height in the direction of the rotational axis of the driven-side flange 155 from the flange end surface 173 and has a width in the circumferential direction of the flange which decreases toward its top. Specifically, two sides 175*a*, 175*b* of the projection 171 are configured as inclined surfaces extending transversely to the circumferential direction of the flange and inclined toward each other (the distance between them decreases) toward the top. Further, as shown in FIG. 11, in this embodiment, a top surface 177 of the projection 171 is a flat surface parallel to the flange end surface 173. Therefore, each of the projections 171 has a trapezoidal section (in this embodiment, an isosceles trapezoidal section having the right and left sides 175*a*, 175*b* equal in length).

Figure 12:
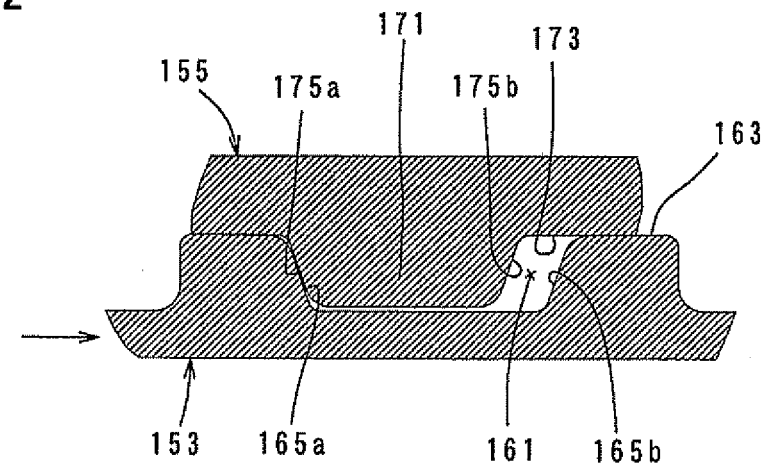
FIG. 12 illustrates the state in which torque is transmitted between the driving-side flange and the driven-side flange.

As shown in FIG. 12, for example, when the driving-side flange 153 rotates in a direction of the arrow (clockwise), one (left) side 165*a* of the recess 161 is engaged with one (left) side 175*a* of the projection 171, so that torque is transmitted from the driving-side flange 153 to the driven-side flange 155. In the following description, for the sake of convenience of explanation, each of the sides 165*a*, 165*b*, 175*a*, 175*b* is referred to as an engagement surface. One engagement surface 165*a* of the recess 161 and one engagement surface 175*a* of the projection 171 are features that correspond to the "recess-side engagement surface" and the "projection-side engagement surface", respectively, according to the invention.

Further, as shown in FIG. 4, the recess 161 is configured such that its width decreases toward its radially outer end (the radially outer surface of the flange) in its radially extending direction. Specifically, each of the two engagement surfaces 165*a*, 165*b* of the recess 161 is inclined toward the other (the distance between them decreases) toward the radially outer end (the radially outer surface of the flange) at a predetermined angle β with respect to a normal P of the driving-side flange 153 which extends from the center of rotation of the driving-side flange 153.

Similarly, as shown in FIG. 8, the projection 171 is configured such that its width decreases toward its radially outer end (the radially outer surface of the flange) in its radially extending direction. Specifically, each of the two engagement surfaces 175*a*, 175*b* of the projection 171 is inclined toward the other (the distance between them decreases) at a predetermined angle β with respect to a normal P of the driven-side flange 155 which extends from the center of rotation of the driven-side flange 155. Therefore, each of the engagement surface 165*a* of the recess 161 and the engagement surface 175*a* of the projection 171 which is engaged with the other when torque is transmitted is configured as an inclined surface which is inclined in a forward direction of torque transmission toward the radially outer end (the radially outer surface of the flange). Further, in this embodiment, the above-described angle β is 30 degrees.

Further, each of the two engagement surfaces 165*a*, 165*b* of the recess 161 is formed as a lead surface in which an edge line 161*a* on one side of the engagement surface adjacent to the flange end surface 163 of the driving-side flange 153 or an edge line 161*b* on the other side far from the flange end surface 163 serves as a guide. Similarly, each of the two engagement surfaces 175*a*, 175*b* of the projection 171 is formed as a lead surface in which an edge line 171*a* on one side of the engagement surface adjacent to the flange end surface 173 of the driven-side flange 155 or an edge line 171*b* on the other side far from the flange end surface 173 serves as a guide.

The torque limiter 151 of the hammer drill 101 according to this embodiment is constructed as described above. Therefore, when excessive torque exceeding a set value defined by a spring force of the biasing spring 157 is exerted on the power transmitting section 117 during drilling operation of the hammer bit 119, the driving-side flange 153 is moved rearward away from the driven-side flange 155 against the spring force of the biasing spring 157 by axial components of forces acting on the engagement surfaces 165*a*, 175*a* of the recess 161 and the projection 171 which are engaged with each other. By this movement, the projection 171 is disengaged from the recess 161 and the top surface 177 of the projection 171 climbs on the flange end surface 163 of the driving-side flange 153. As a result, torque transmission is interrupted, so that the power transmitting section 117 and the driving motor 111 can be protected from being overloaded.

According to this embodiment, the engagement surfaces 165*a*, 165*b* of the recess 161 and the engagement surfaces 175*a*, 175*b* of the projection 171 are inclined at the predetermined angle β with respect to the normals P of the driving-side flange 153 and the driven-side flange 155, respectively. With such a construction, an area of contact between the engagement surface 165*a* of the recess 161 and the engagement surface 175*a* of the projection 171 can be increased, compared with a conventional construction in which engagement surfaces of the projection and the recess are formed by inclined surfaces extending linearly along normals P. In this embodiment, by provision of the construction with the above-described inclination angle β of 30 degrees, this contact area can be increased about 15%. As a result, pressure per unit area on a torque transmission surface in the form of the engagement surface is reduced, so that wear resistance can be enhanced.

Further, according to this embodiment, each of the recess 161 and the projection 171 is configured such that its width in the circumferential direction of the flange decreases toward its radially outer end (the radially outer surface of the flange). Therefore, when the driving-side flange 153 and the driven-side flange 155 are molded by using dies, they can be easily demolded, so that ease of manufacture is increased.

Further, according to this embodiment, the engagement surfaces 165*a*, 165*b*, 175*a*, 175*b* of the recess 161 and the projection 171 are formed as the lead surfaces in which the edge lines 161*a*, 171*a* on one side of the engagement surface adjacent to the flange end surfaces 163, 173 or the edge lines 161*b*, 171*b* on the other side far from them serve as a guide. Therefore, surface contact between the engagement surfaces can be constantly maintained while the recess-side engagement surfaces 165*a*, 165*b* and the projection-side engagement surfaces 175*a*, 175*b* are engaged with each other or until they are disengaged from each other.

Further, according to this embodiment, the recess 161 is formed in the driving-side flange 153 having the second transmission gear 133 integrally formed therewith. Therefore, compared with a construction in which the projection 171 is formed on the driving-side flange 153, a gearing part can be more easily manufactured without interference of the projection.

Further, in this embodiment, the recess 161 is formed in the driving-side flange 153 and the projection 171 is formed on the driven-side flange 155, but the projection 171 may be formed on the driving-side flange 153 and the recess 161 may be formed in the driven-side flange 155. In this embodiment, each of the recess 161 and the projection 171 is shaped such that its width in the circumferential direction of the flange decreases toward its radially outer end, but may be shaped such that the width increases toward its radially outer end. Further, the inclination angle β with respect to the normal P of the engagement surface is set to 30 degrees, but it is not limited to this. Further, each of the recess 161 and the projection 171 is formed symmetrically with respect to a straight line (normal) extending from the center of rotation through the center of the recess 161 or the projection 171, but they do not have to be line-symmetric.

Further, in this embodiment, the hammer drill 101 is explained as a representative example of the power tool according to the invention, but the invention can be applied to any power tool in which a predetermined operation is performed by rotation of a tool bit.

Description of Numerals

101 hammer drill (power tool)
103 body
105 motor housing
107 gear housing
109 handgrip
109*a* trigger
111 driving motor
112 motor output shaft
113 motion converting section
115 striking part
117 power transmitting section
119 hammer bit
121 driving gear
123 driven gear
124 cylindrical element
125 intermediate shaft
126 bearing
127 rotating element
128 swinging rod
129 swinging ring
130 cylindrical piston
130*a* air chamber
131 first transmission gear
133 second transmission gear
137 tool holder
141 cylinder
141*a* spherical recess
143 striker
145 impact bolt
151 torque limiter
153 driving-side flange (first rotating member)
155 driven-side flange (second rotating member)
155*a* spherical recess
157 biasing spring
158 spring receiving ring
159 ball
161 recess
161*a*, 161*b* edge line
163 flange end surface
165*a*, 165*b* side (engagement surface)
167 bottom surface
171 projection
171*a*, 171*b* edge line
173 flange end surface
175*a*, 175*b* side (engagement surface)
177 top surface

We claim:

1. A power tool comprising a torque transmission device that transmits torque and interrupts torque transmission between a first rotating member and a second rotating member which are coaxially arranged to be opposed to each other, the torque transmission device comprising:

a projection formed on one of opposed surfaces of the first and second rotating members and protruding in a direction of a rotational axis, a recess for receiving the projection, which is formed in the other of the opposed surfaces and recessed in the direction of the rotational axis, a pair of projection-side engagement surfaces formed on side surfaces of the projection in a direction of torque transmission, the projection-side engagement surfaces being oriented such that a gap defined therebetween asymptotically decreases toward a radially outer end in a radially extending direction, and a pair of recess-side engagement surfaces formed on side surfaces of the recess in the direction of torque transmission, the recess-side engagement surfaces being oriented such that a gap defined therebetween asymptotically decreases toward a radially outer end in the radially extending direction, torque is transmitted when the projection-side and recess-side engagement surfaces are engaged with each other by relative movement of the first and second rotating members toward each other, while the torque transmission is interrupted when the projection-side and recess-side engagement surfaces are disengaged from each other by relative movement of the first and second rotating members away from each other, wherein the projection-side and recess-side engagement surfaces are inclined at a predetermined angle with respect to normals of the first and second rotating members.

2. The power tool as defined in claim 1, wherein, provided that the recess is formed on a driving side, each of the projection-side and recess-side engagement surfaces is inclined in a forward direction of torque transmission toward its radially outer end.

3. The power tool as defined in claim 1, wherein the projection-side engagement surface is formed as a lead surface in which an edge line on one side of the engagement surface adjacent to the rotating member or an edge line on the other side of the engagement surface far from the rotating member serves as a guide.

4. The power tool as defined in claim 1, wherein the torque transmission device is provided as a torque limiter which interrupts torque transmission from the first rotating member to the second rotating member when torque exceeding a specified value acts upon the second rotating member.

5. The power tool as defined in claim 1, wherein the rotating member having the recess is designed as a driving-side member for transmitting torque and the rotating member having the projection is designed as a driven-side member for receiving the torque, and the driving-side member has a gear integrally formed on its periphery.

6. The power tool as defined in claim 1, wherein the projection-side and recess-side engagement surfaces are inclined at a predetermined angle with respect to normals of the first and second rotating members, so that an area of contact between the engagement surfaces is increased and pressure per unit area on the engagement surfaces is reduced and wear resistance of the engagement surfaces is enhanced.

* * * * *